US010287732B1

(12) United States Patent
Warford

(10) Patent No.: US 10,287,732 B1
(45) Date of Patent: May 14, 2019

(54) TEMPORARY WALKWAY

(71) Applicant: Lawrence Eugene Warford, Bonney Lake, WA (US)

(72) Inventor: Lawrence Eugene Warford, Bonney Lake, WA (US)

( * ) Notice: Subject to any disclaimer, the term of this patent is extended or adjusted under 35 U.S.C. 154(b) by 0 days.

(21) Appl. No.: 15/940,970

(22) Filed: Mar. 30, 2018

(51) Int. Cl.
*E01C 5/00* (2006.01)
*E01C 5/16* (2006.01)

(52) U.S. Cl.
CPC ..... *E01C 5/16* (2013.01); *E01C 5/005* (2013.01)

(58) Field of Classification Search
CPC ..... E01C 5/16; E01C 5/005
USPC ..... 404/34–36, 40, 41; 52/79.1, 578; 14/69.5
See application file for complete search history.

(56) References Cited

U.S. PATENT DOCUMENTS 3,043,407 A * 7/1962 Marryatt ..... E04C 2/08 52/177
5,032,037 A * 7/1991 Phillips ..... E01C 9/086 404/35
D332,148 S * 12/1992 Tal ..... D25/138
5,862,983 A * 1/1999 Andrus ..... E01C 9/08 238/14
5,971,655 A * 10/1999 Shirakawa ..... E01C 5/005 404/34
6,089,784 A * 7/2000 Ardern ..... E01C 9/08 403/375
7,025,530 B2 * 4/2006 Beamish ..... E01C 9/08 404/35
7,160,055 B2 * 1/2007 Beamish ..... E01C 9/08 404/34
7,240,388 B2 * 7/2007 Warford ..... A61G 3/061 14/69.5
7,364,383 B2 * 4/2008 Fletcher ..... E01C 9/086 404/35
7,427,172 B2 * 9/2008 Lukasik ..... E01C 5/18 404/17
7,604,431 B2 * 10/2009 Fournier ..... E01C 9/08 404/35
7,934,885 B2 * 5/2011 Fournier ..... E01C 9/086 404/35
8,061,929 B2 * 11/2011 Dagesse ..... E01C 9/086 404/34
8,146,317 B1 * 4/2012 Fletcher ..... E01C 5/005 52/582.1
8,545,127 B2 * 10/2013 Bleile ..... E01C 5/001 404/34
8,616,804 B2 * 12/2013 Corser ..... E01C 9/086 404/34
8,870,492 B2 * 10/2014 Stasiewich ..... E01C 9/08 405/39
D767,170 S * 9/2016 Labonte ..... D25/138
9,732,528 B1 * 8/2017 Kuo ..... E04F 11/002
2002/0176745 A1 * 11/2002 Stasiewich ..... E01C 9/086 404/41

(Continued)

*Primary Examiner* — Raymond W Addie
(74) *Attorney, Agent, or Firm* — Joseph Z Ellsworth

(57) ABSTRACT

A temporary walkway used in construction areas to allow access to a building before the concrete sidewalk is installed. The temporary walkway has plank sections made up of a panel and a leading and a trailing edge. The leading edge is configured to lock into the trailing edge of an adjacent plank to create a large walk way. The Planks remain locked throughout an upward and downward angle of rotation to account for variance in the terrain.

15 Claims, 4 Drawing Sheets

(56) References Cited

U.S. PATENT DOCUMENTS

| | | | | |
|---|---|---|---|---|
| 2004/0141809 | A1* | 7/2004 | Wagstaff | E01C 9/083<br>404/35 |
| 2006/0029470 | A1* | 2/2006 | Berlin | E02B 3/06<br>405/4 |
| 2006/0156492 | A1* | 7/2006 | Warford | A61G 3/061<br>14/69.5 |
| 2006/0165486 | A1* | 7/2006 | Ungurean | E01C 9/083<br>404/40 |
| 2006/0285921 | A1* | 12/2006 | Fletcher | E01C 9/086<br>404/35 |
| 2009/0255066 | A1* | 10/2009 | Brock | A63C 19/10<br>14/69.5 |
| 2014/0328623 | A1* | 11/2014 | Ringus | E01C 9/02<br>404/35 |
| 2015/0098757 | A1* | 4/2015 | Mitchell | E01C 13/045<br>404/40 |
| 2016/0115653 | A1* | 4/2016 | Forbes | E01C 5/14<br>404/35 |

* cited by examiner

TEMPORARY WALKWAY

FIELD OF THE INVENTION

The embodiments of the invention relates to temporary metallic walkways.

BACKGROUND

Construction sites require foot and wheeled traffic for months before the exterior landscaping has been completed. The foot traffic can track mud and detritus into the construction site.

Wheeled vehicles can get stuck in mud or against discarded construction material. Some construction sites put down plywood which can be a tripping hazard at the overlaps.

Some nations or regions require handicap access to buildings while the landscape is under construction or otherwise do not have sidewalks.

Others may be in need of a walkway immediately and can't wait for setting up forms and drying of concrete.

SUMMARY OF THE INVENTION

Solutions to the problems stated above have been solved by the current invention. An embodiment of the invention provides a walkway that is rigid and can be quickly installed and removed. The temporary walkway comprises a plurality of planks comprising a rigid panel as the walking surface, a leading edge and a trailing edge, wherein, the leading edge is configured to couple with a trailing edge of an adjacent panel. This allows a user to create a walkway of any length. Further, the temporary walkway comprises a locking member on the leading edge, and a land on the trailing edge wherein, the locking member prevents the leading edge from disengaging from the trailing edge. The locking feature allows the walkway to be quickly assembled but prevents inadvertent disassembly during normal use.

A walkway plank comprises, a panel, a leading edge and a trailing edge, a locking member on the leading edge, a land on the trailing edge, a cylindrical portion on the trailing edge, and a lip on the leading edge. The cylindrical portion and the lip are round and when couples share the same axis. This allows rotation around the axis during engagement of the planks.

A method for assembling a temporary walkway comprises, positioning a first plank leading edge adjacent a second plank trailing edge and rotating the first plank relative the second plank until a lip fits under a cylindrical portion of the second plank trailing edge. Then rotating the first plank downward until the lip moves past the cylindrical portion into the channel, and locking the first and second plank by rotating until the locking member engages the land.

DETAILED DESCRIPTION

Figure 1:
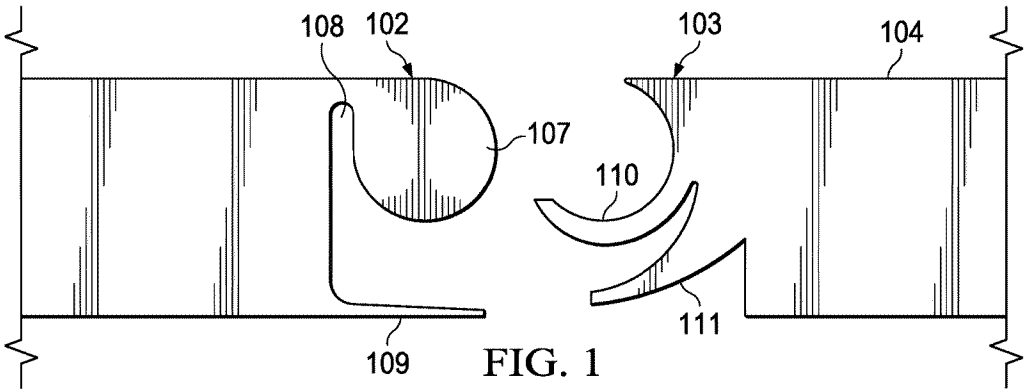
FIG. 1. Close up side view of the temporary walk way leading and trailing edge.
Figure 2:
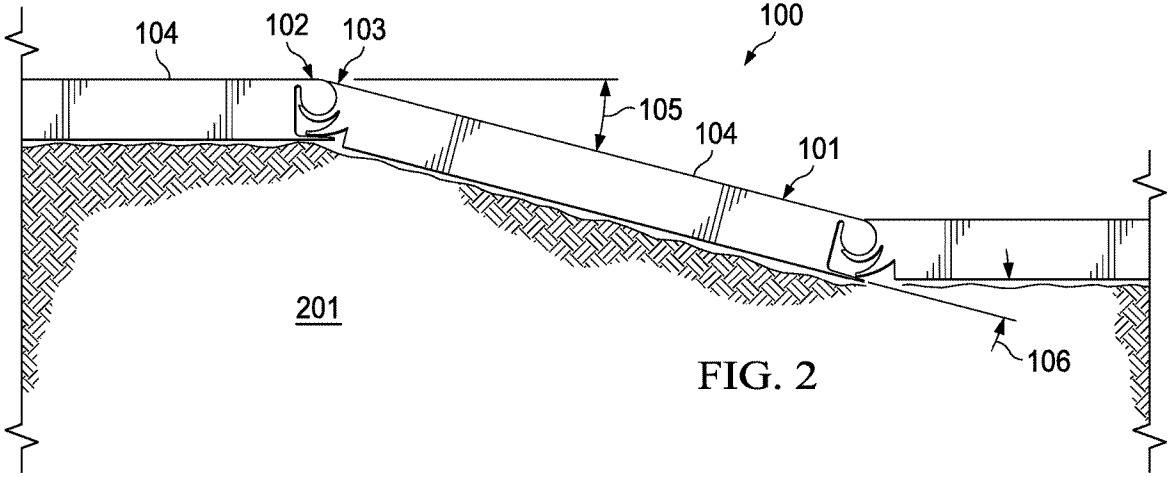
FIG. 2. Side view an assembled temporary walkway on an exemplary uneven surface.
Figure 3:
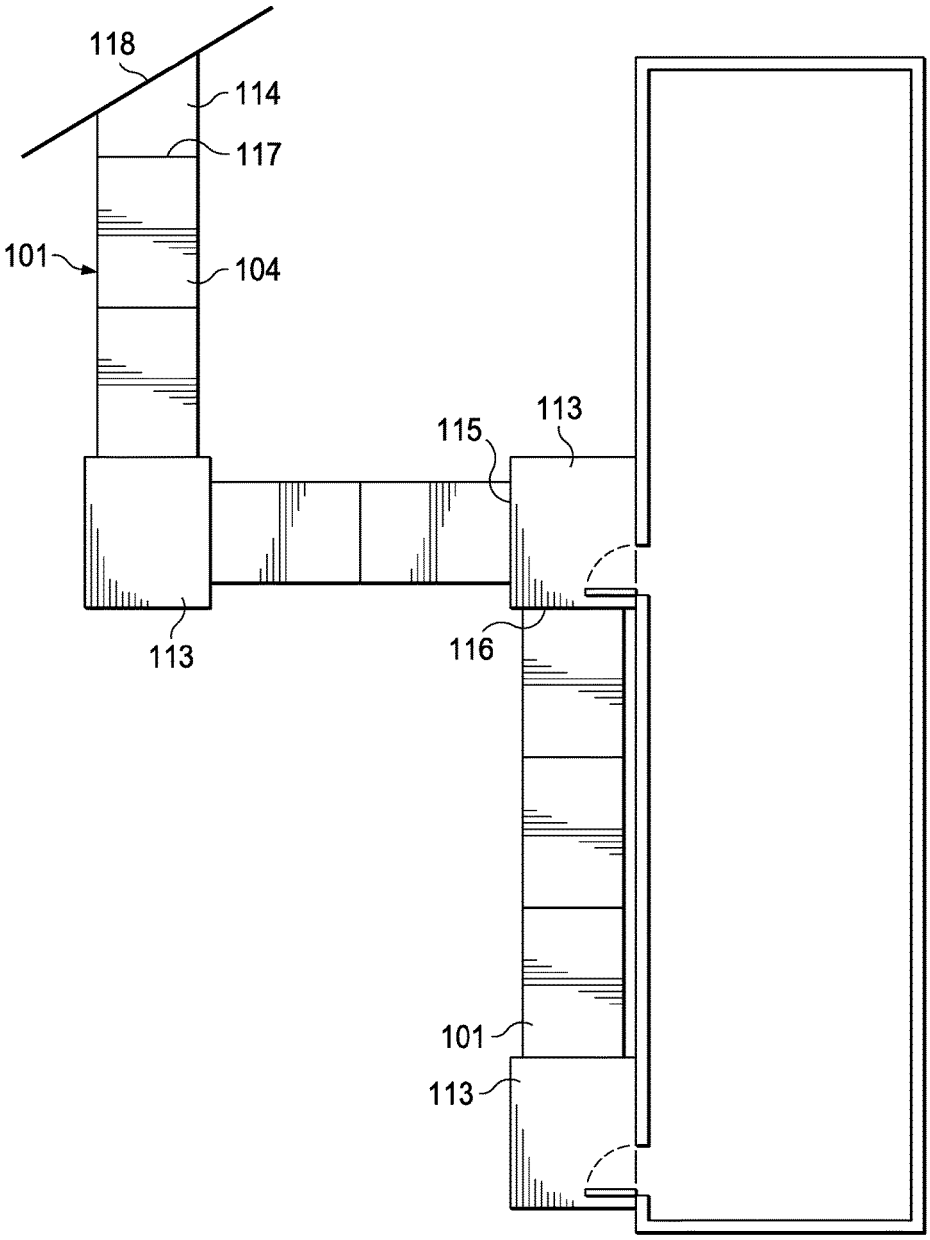
FIG. 3. Plan view of a temporary walkway extending past and away from a building and interfacing with a permanent sidewalk.

A temporary walkway is smooth and has no edges or lips that can be tripped over. The walkway is in pieces that can be easily carried and the pieces are easily joined without tools. The walkway can conform to the topography of the landscape.

A temporary walkway 100 comprises a series of planks 101 having a leading edge 102, a trailing edge 103, and a panel 104. The leading edge 102 of one plank 101 is configured to lock into the trailing edge 103 of an adjacent plank 101. The panel portion is the stiffened walking surface of the plank 101. The leading edge 102 and trailing edge 103 are configured to remain locked at an offset angle downward 105 or an offset angle upward 106 to match the landscape 201. An example maximum angle between planks that is still acceptable for handicap access is five degrees.

The leading edge 102 of the plank 101 comprises a cylindrical portion 107, a channel 108 and a lower land 109. The trailing edge 103 comprises a lip 110 and a locking member 111. The lip 110 is configured to match the shape of the cylindrical portion 107 and fit into the channel 108. The locking member 111 may be substantially parallel to the lip 110 and slideably engage the lower land 109. The locking member 111 allows two adjoining planks 101 to be locked together through an upward angle 106 and a downward angle 105. The locking member 111 is held in place by lower land 109 and doesn't allow lip 110 out of channel 108 or past cylindrical portion 107. When an adjacent plank 101 rotates relative to another plank greater than an upward angle 106 the panels unlock and can be removed. Unlocking is defined as allowing adjacent planks to translate relative to each other and the connection is loose or sloppy. Disengaging the planks 101 is accomplished by rotating a plank above a disengagement angle 112 and translating the lip 110 under the cylindrical portion 107.

Figure 4:
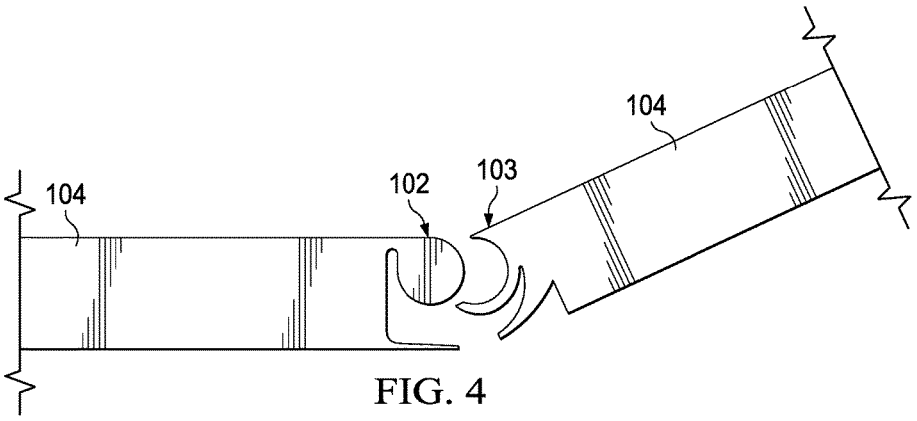
FIG. 4. Side view close up of a leading and trailing edge.

In FIG. 4, a pair of planks 101 are lined up to be engaged to each other. The leading edge 103 of one plank must be rotated at a high angle to allow the lip 110 to fit under the cylindrical portion 107.

Figure 5:
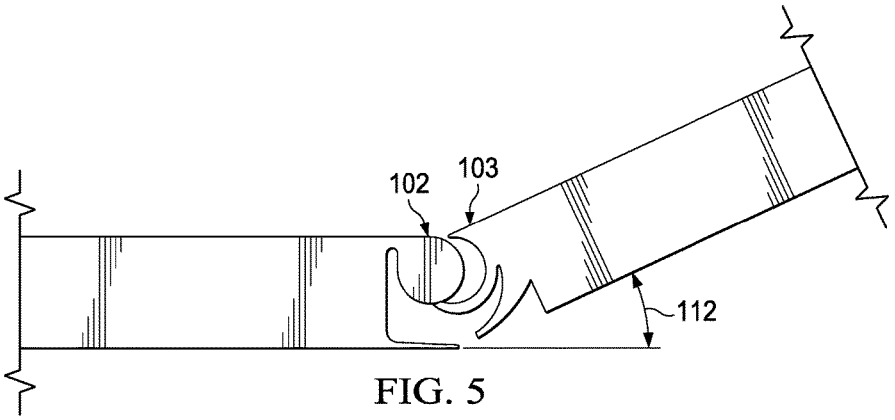
FIG. 5. Side view close up of a leading and trailing edge about to engage.

In FIG. 5, The leading edge 103 and the trailing edge 102 are touching and the lip 110 is just about to move under the cylindrical portion 107.

Figure 6:
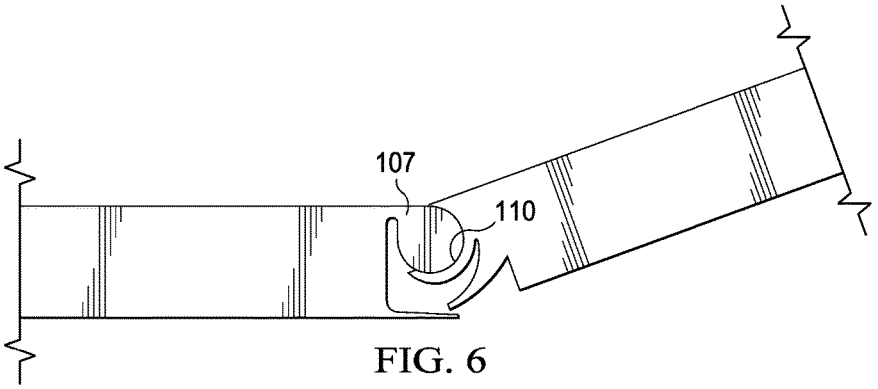
FIG. 6. Side view close up of a leading and trailing edge engaged but not locked.

In FIG. 6, the pair of planks are pushed together at a high angle so the lip 110 engages the cylindrical portion 107 but is not locked.

Figure 7:
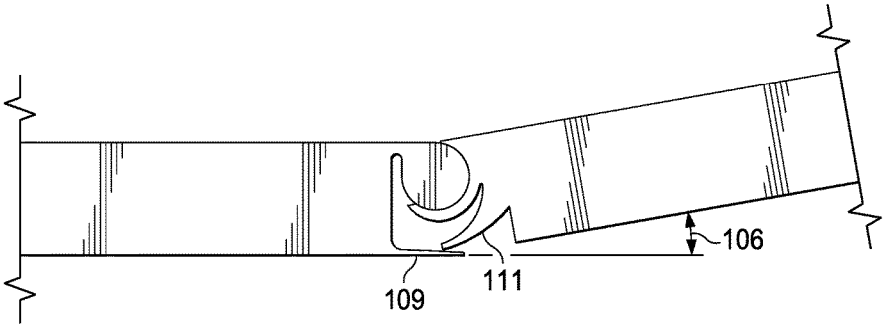
FIG. 7. Side view close up of a leading and trailing edge locked and having an upward angle.

In FIG. 7, the leading edge 103 of on plank 101 is rotated downward until the locking mechanism 111 touches the land 109. This locks the two planks 101 together at a upward angle 106 of, for example, five degrees.

Figure 8:
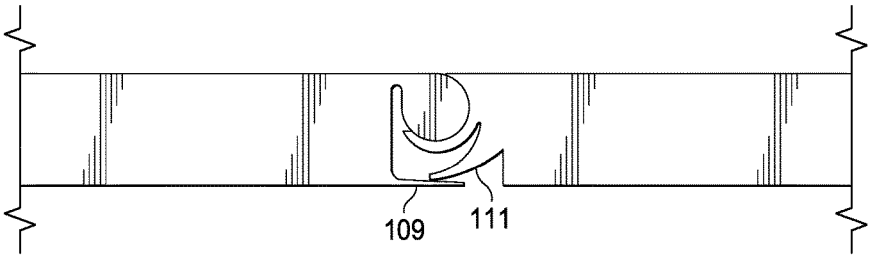
FIG. 8. Side view close up of a leading and trailing edge locked and flat.

In FIG. 8, the adjoining planks in the flat position and locked.

Figure 9:
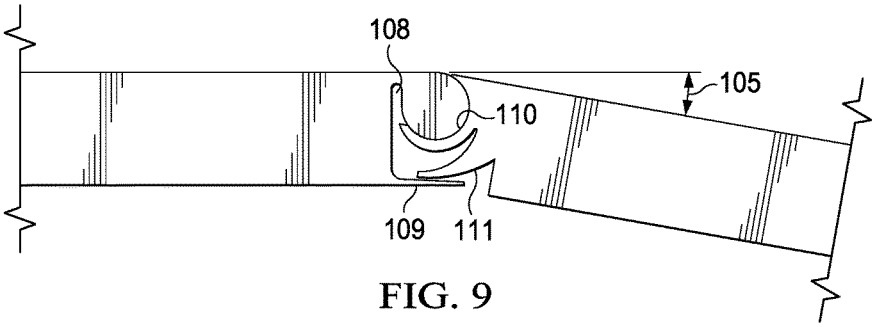
FIG. 9. Side view close up of a leading and trailing edge locked at a downward angle.

In FIG. 9, the adjoining planks are at a downward angle 105 and remain locked.

In many instances a walkway can't be a strait run. It may be necessary to change directions or meet up with a permanent sidewalk that extends at an angle. Accordingly, a plank may be coupled to a corner connection section 113 which is a rectangle shape. The four sides of corner connection section 113 may have at least one of a leading edge 103 or trailing edge 102. For Example, a plank 101 can be coupled to trailing edge 102 on the first side 116 of corner connection section 113 and then attach another plank 101 to the leading edge 103 of second side 115 extending away at 90 degrees. To interface with a permanent sidewalk at non-perpendicular direction an angled section 114 can be used. An angled section 114 has a trailing edge 103 on one side and an angle matching the item to be interfaced with. Further, A temporary walkway 100 comprises, a plurality of planks 101 comprising, a panel 104, a leading edge 103 and a trailing edge 102, wherein, the leading edge 103 is configured to couple with a trailing edge 102 of an adjacent plank 101. The temporary walkway 100 further comprises, a locking member 111 on the leading edge, and a land 109 on the trailing edge wherein, the locking member 111 prevents the leading edge 103 from disengaging from the trailing edge 102. Also, the temporary walkway 100 further comprises a cylindrical portion 107 on the trailing edge 102, and a lip 110 on the leading edge 103, wherein the lip 110 and the cylindrical portion 107 share substantially the same axis when coupled. A locking member 111 on the leading edge, and a land 111 on the trailing edge 103 keep the lip 110 in the channel 108 and prevent the lip 110 from translating past the cylindrical portion 107. The locking member 111 is configured to lock the trailing edge to the leading edge at offset angle upward 106 of five degrees and offset angle downward 105 of five degrees. A temporary walkway 100 leading edge 103 is configured to be engaged to the trailing edge 102 at an offset angle downward 105 or an offset angle upward 106.

A corner connection section 113 comprises at least one trailing edge configured to couple to a plank leading edge and, a leading edge configured to couple to a plank trailing edge. The corner connection section 113 is a rectangle, and the first side 116 and the second side 115 are at a 90 degree angle from each other. Each side of a corner connection section can have either a leading or trailing edge. An angled portion 114 is configured to interface to a permanent walkway or roadway or other permanent item at a complementary angle, wherein, a non-interface side 117 comprises a trailing edge.

A walkway plank 101 comprises a panel 104, a leading edge 103 and a trailing edge 102, a locking member 111 on the leading edge, a land 109 on the trailing edge, a cylindrical portion 107 on the trailing edge, and a lip 110 on the leading edge. Additionally, the temporary walkway plank further comprises, a locking member 111 on the leading edge, and a land 109 on the trailing edge wherein, the locking member 111 is configured to prevent a lip 110 from disengaging from the cylindrical portion 107.

A method for assembling a temporary walkway comprising, positioning a first plank leading edge 103 adjacent a second plank trailing edge 102, rotating the first plank relative the second plank until a lip 110 fits under a cylindrical portion 107 of the second plank trailing edge, rotating the first plank downward until the lip 110 moves past the cylindrical portion 107, and locking the first and second plank by rotating until the locking member 111 engages the land 109. The locking member 111 is of a sufficient length that it engages the land 109 at an offset angle upward 106 of five degrees. The land 109 is sized to allow an offset angle downward 105 of five degrees. The land 109 hits on the plank leading edge 103 to prevent more rotation than desired or designed. The method further comprises, coupling a corner connection section 113 to the leading edge 103 of a plank and, coupling the trailing edge 102 of a plank to another side of the corner connection section 113. The four sides of a connection section 113 can have any combination of trailing edges or leading edges.

The method may include coupling an angled section 114 to a plank 101. The angled section 114 has an interface edge 118 that is configured to interface with a permanent walkway or roadway.

The method may further comprise, coupling a plank trailing edge 102 to a first side 116 of a corner connection section 113, coupling a plank leading edge 103 to a corner connection section second side 115 extending away at an alternate angle. The second side 115 may be at a right angle to the first side 116. The method may further comprise rotating the lip 110 about a centerline of the cylindrical portion 107 to couple and lock the adjacent planks together. This method may be utilized to construct a temporary sidewalk 100.

The invention claimed is:

1. A temporary walkway comprising,
a plurality of planks,
the planks comprising,
a panel, a leading edge and a trailing edge,
wherein, the leading edge is configured to couple with a trailing edge of an adjacent plank,
a cylindrical portion on the trailing edge, and
a lip on the leading edge,
wherein the lip and the cylindrical portion share substantially the same axis when coupled,
a locking member on the leading edge, and
a land on the trailing edge wherein,
the locking member runs substantially parallel to the lip wherein,
the locking member is configured to lock the trailing edge to the leading edge at an offset angle of up to five degrees upward and up to five degrees downward.

2. The temporary walkway of claim 1 wherein,
the leading edge is configured to be engaged to the trailing edge at an offset angle downward or an offset angle upward.

3. The temporary walkway of claim 1 further comprising,
an angled portion configured to interface to a permanent walkway at a complementary angle,
wherein, a non-interface side comprises a trailing edge.

4. The temporary walkway of claim 1 further comprising,
a corner connection section comprising at least one trailing edge configured to couple to a plank leading edge and,
a leading edge configured to couple to a plank trailing edge.

5. The temporary walkway of claim 4 wherein,
the corner connection section is a rectangle, and
a first side having the leading edge and a second side having the trailing edge are at a 90 degree angle from each other.

6. A walkway plank comprising,
a panel, a leading edge and a trailing edge,
a locking member on the leading edge,
a land on the trailing edge,
a cylindrical portion on the trailing edge, and
a lip on the leading edge parallel to the locking member wherein,
the locking member is configured to lock the trailing edge to the leading edge at an offset angle of up to five degrees upward and up to five degrees downward.

7. The temporary walkway plank of claim 6 further comprising,
a locking member on the leading edge, and a land on the trailing edge wherein, the locking member is configured to prevent the lip from disengaging from the cylindrical portion.

8. A method for assembling a temporary walkway comprising, positioning a first plank leading edge adjacent a second plank trailing edge, rotating the first plank relative the second plank until a lip fits under a cylindrical portion of the second plank trailing edge, rotating the first plank downward until the lip moves past the cylindrical portion, and locking the first and second plank by rotating until the locking member, located on the leading edge and running substantially parallel to the lip, engages the land wherein, the locking member engages the land at an offset angle upward of five degrees.

9. The method of claim 8 wherein, the land is sized to allow an offset angle downward of five degrees.

10. The method of claim 8 further comprising, coupling a corner connection section to the leading edge of a plank and, coupling a trailing edge of a plank to another side of the corner connection section.

11. The method of claim 8 further comprising, coupling an angled section to a plank.

12. The method of claim 8 further comprising, coupling a plank trailing edge to a first side of a corner connection section, coupling a plank leading edge to a corner connection section second side extending away at an alternate angle.

13. The method of claim 12 wherein, the second side is at a right angle to the first side.

14. The method of claim 8 wherein, the lip rotates about a centerline of the cylindrical portion.

15. A temporary sidewalk constructed from the method of claim 8.

* * * * *